US010188232B2

(12) United States Patent
Lee et al.

(10) Patent No.: US 10,188,232 B2
(45) Date of Patent: Jan. 29, 2019

(54) DECORATIVE ARTICLE WITH RECEIVING MEMBER

(71) Applicant: Hee Kyung Lee, Suwon-si (KR)

(72) Inventors: Hee Kyung Lee, Suwon-si (KR); Hyun Uk Park, Suwon-si (KR)

(73) Assignee: Hee Kyung Lee, Suwon-si (KR)

( * ) Notice: Subject to any disclaimer, the term of this patent is extended or adjusted under 35 U.S.C. 154(b) by 152 days.

(21) Appl. No.: 15/263,327

(22) Filed: Sep. 12, 2016

(65) Prior Publication Data

US 2017/0105553 A1 Apr. 20, 2017

(30) Foreign Application Priority Data

Oct. 16, 2015 (KR) ..... 20-2015-0006764 U

(51) Int. Cl.

| | |
|---|---|
| ***A47F 5/08*** | (2006.01) |
| ***A47G 29/08*** | (2006.01) |
| ***A47B 97/00*** | (2006.01) |
| *A47F 7/00* | (2006.01) |
| *B44C 5/00* | (2006.01) |

(52) U.S. Cl.

CPC ..... *A47G 29/08* (2013.01); *A47B 97/00* (2013.01); *A47F 5/0815* (2013.01); *A47F 5/0823* (2013.01); *A47F 5/0846* (2013.01); *A47F 7/0078* (2013.01); *B44C 5/00* (2013.01); *Y10S 211/00* (2013.01); *Y10S 248/911* (2013.01); *Y10S 248/912* (2013.01); *Y10S 248/915* (2013.01); *Y10T 428/24008* (2015.01); *Y10T 428/2419* (2015.01); *Y10T 428/24273* (2015.01); *Y10T 428/24298* (2015.01); *Y10T 428/24314* (2015.01)

(58) Field of Classification Search

None

See application file for complete search history.

(56) References Cited

U.S. PATENT DOCUMENTS 2,534,550 A * 12/1950 Frechtmann ..... A63F 9/06 273/157 R
2,551,539 A * 5/1951 Horton ..... G09F 7/06 248/220.31

(Continued)

FOREIGN PATENT DOCUMENTS

CA 2538844 A1 * 9/2006
DE 1053915 B * 3/1959 ..... G09F 7/00

(Continued)

OTHER PUBLICATIONS

Machine Translation of DE 4327847 A1, Feb. 1995 (Year: 1995).*

*Primary Examiner* — Jeffrey A Vonch

(74) *Attorney, Agent, or Firm* — Korus Patent, LLC; Seong Il Jeong

(57) ABSTRACT

A decorative article comprises a base plate having at least one hanging elongate slot defined therein; and a receiving member including a single first plate, at least two second plates, and a hanger, wherein the first plate is parallel to the base plate, and each of the at least two second plates is non-parallel to the base plate and is coupled to the first plate, to define an inner space and a top opening in the receiving member, wherein the hanger protrudes from the first plate, wherein the hanger is fitted into the hanging elongate slot to secure the receiving member to the base plate.

15 Claims, 4 Drawing Sheets

(56) References Cited

U.S. PATENT DOCUMENTS 2,759,295 A * 8/1956 Keuls ..... A63F 9/0819 248/220.31
2,769,553 A * 11/1956 Horton ..... G09F 7/06 211/169
2,800,380 A * 7/1957 Baker ..... A47B 87/02 312/245
2,814,894 A * 12/1957 Horton ..... G09F 7/00 248/220.31
2,974,918 A * 3/1961 Voigtlander ..... A47B 57/46 248/201
3,187,924 A * 6/1965 William ..... A47F 5/0823 220/480
3,191,777 A * 6/1965 Willits, Jr. ..... A47F 5/0815 211/106.01
3,193,231 A * 7/1965 Curry ..... A47F 5/0823 24/DIG. 52
3,198,469 A * 8/1965 Callanan ..... A47F 5/0823 248/220.22
3,216,584 A * 11/1965 Sedo ..... A47F 5/0823 248/220.41
3,235,218 A * 2/1966 Graham ..... A47F 5/0846 248/215
3,269,550 A * 8/1966 William ..... B25H 3/04 211/70.6
3,281,102 A * 10/1966 Hobson ..... A47B 57/42 108/108
3,310,271 A * 3/1967 King ..... A47F 5/0815 248/220.43
3,502,294 A * 3/1970 Kalbow ..... A47F 5/0025 211/41.2
3,850,396 A * 11/1974 Orlandi ..... A47F 5/0815 248/220.42
3,858,727 A * 1/1975 Levko ..... G09F 7/06 211/57.1
3,871,608 A * 3/1975 Ogden ..... A47F 5/0823 248/220.41
3,880,390 A * 4/1975 Niven ..... A47F 5/0815 248/220.43
3,908,948 A * 9/1975 Hawthorne ..... A47F 5/0823 211/74
3,921,948 A * 11/1975 Long ..... A47F 5/0823 211/75
4,204,602 A * 5/1980 Dunchock ..... A47F 7/021 211/85.1
4,322,006 A * 3/1982 Marschak ..... A47F 5/0823 211/126.2
D267,607 S * 1/1983 Peabody ..... A47F 5/0815 D6/570
D268,383 S * 3/1983 Peabody ..... D6/529
4,434,960 A * 3/1984 Berry ..... A47F 5/0815 248/220.43
4,441,619 A * 4/1984 Gibitz ..... B25H 3/04 211/59.1
4,687,094 A * 8/1987 Allsop ..... A47F 5/0823 206/45.26
4,708,311 A * 11/1987 Clausen ..... A47F 5/0846 211/87.01
4,852,930 A * 8/1989 Agee ..... A47F 5/0807 294/143
4,993,583 A * 2/1991 Chasen ..... A47F 1/04 206/362
4,993,984 A * 2/1991 Matarese ..... A63F 9/0669 273/282.3
D335,996 S * 6/1993 Evenson ..... D19/90
5,215,200 A * 6/1993 Rosenthal ..... A47F 5/0823 211/187
5,375,802 A * 12/1994 Branham, II ..... A47F 5/0846 211/94.01
5,379,976 A * 1/1995 DeGirolamo ..... A47F 5/0815 248/220.43
5,477,969 A * 12/1995 Beeskau ..... A47F 5/0815 211/90.02
5,556,068 A * 9/1996 Gorelik ..... A47F 5/0823 248/214
5,582,376 A * 12/1996 Thompson ..... A47B 96/067 211/94.01
5,641,079 A * 6/1997 Schmidt ..... A47F 5/0823 211/104
5,673,803 A * 10/1997 Burback ..... A47F 5/0823 211/87.01
5,727,696 A * 3/1998 Valiulis ..... A47F 1/126 211/51
5,775,521 A * 7/1998 Tisbo ..... A47B 17/033 211/11
6,129,220 A * 10/2000 Decossas ..... A47F 5/0823 211/13.1
6,216,375 B1 * 4/2001 Griffin ..... G09F 7/10 40/618
D446,414 S * 8/2001 Schafer ..... D6/553
6,722,619 B2 * 4/2004 Valiulis ..... A47F 5/0823 248/220.31
6,929,131 B1 * 8/2005 Landi ..... A47F 5/0846 211/87.01
D582,190 S * 12/2008 Valiulis ..... D6/567
D587,947 S * 3/2009 Valiulis ..... D6/553
D594,229 S * 6/2009 Barkdoll ..... D3/304
D594,230 S * 6/2009 Barkdoll ..... D3/304
D678,701 S * 3/2013 Hansen ..... D6/561
D681,119 S * 4/2013 Stravitz ..... D19/85
2004/0140282 A1 * 7/2004 Wang ..... A47F 7/14 211/113
2005/0242047 A1 * 11/2005 Winig ..... A47F 5/0815 211/59.1
2007/0012636 A1 * 1/2007 Wisnoski ..... A47F 5/0846 211/70.6
2007/0131631 A1 * 6/2007 Dewey ..... A47F 5/0815 211/59.1
2008/0099417 A1 * 5/2008 Zandt ..... A47F 5/0823 211/57.1
2008/0202039 A1 * 8/2008 Picchio ..... A47B 95/008 52/36.5
2009/0134290 A1 * 5/2009 Begic ..... A47B 96/067 248/222.13
2009/0139127 A1 * 6/2009 Southard ..... A47G 1/065 40/761
2010/0290214 A1 * 11/2010 Weng ..... A47F 11/10 362/127
2010/0313508 A1 * 12/2010 Anders ..... E04F 13/08 52/311.1
2012/0228293 A1 * 9/2012 Combs ..... A45F 5/02 220/200
2013/0125495 A1 * 5/2013 Thrush ..... F16M 13/02 52/588.1

FOREIGN PATENT DOCUMENTS

DE 1906664 U * 12/1964 ..... A47F 5/083
DE 4327847 A1 * 2/1995 ..... A47F 5/0807
EP 1566121 A1 * 8/2005 ..... A47F 5/083
FR 2077712 A1 * 11/1971 ..... A47F 5/0846
GB 106755 A * 7/1917 ..... A47F 5/0815
GB 754148 A * 8/1956 ..... G09F 7/06
GB 2026850 A * 2/1980 ..... A47F 5/0815
GB 2034579 A * 6/1980 ..... A47F 5/0025
GB 1585433 A * 3/1981 ..... A47B 96/027
GB 2213306 A * 8/1989 ..... G09F 7/06
JP S39-014895 U 6/1964
JP S49-094997 U 12/1972
KR 20-0303963 Y1 2/2003
KR 20-0457289 Y1 12/2011
KR 10-1150047 B1 5/2012
KR 20-0473753 Y1 7/2014
WO WO-2009051798 A2 * 4/2009 ..... A47F 5/0846

* cited by examiner

DECORATIVE ARTICLE WITH RECEIVING MEMBER

BACKGROUND

Field of the Present Disclosure

The present disclosure relates to a decorative article with a receiving member, and, more particularly, to a decorative article with a receiving member to exhibit a decorative function using a pattern or geometrical shape formed in a base plate and to allow a receiving member to be hung thereon at various locations and to be removed therefrom.

Generally, a variety of decorative articles may be provided for aesthetic purpose indoors. The decorative articles may be installed on the floor or ceil or walls. The wall-mounted decorative articles may include a picture frame.

KR utility patent No. 20-0303963 (Jan. 29, 2003) discloses a decorative article having a recess pattern in a rear portion thereof wherein the recess pattern has a metal powder applied thereto to exhibit different colors based on a view angle.

KR utility patent No. 10-1150047 (May, 18, 2012) discloses a decoration article for a wall comprising frames, connection units, and decoration plates, wherein the frames are separated from each other and comprise coupling units and hanging pieces; the coupling units are formed in both ends of the frames; the hanging pieces are formed on the front surface of the frames; the connection units are fixed to a wall; the decoration plates are formed between the frames.

KR utility patent No. 20-0457289 (Dec. 7, 2011) discloses a box type decorative article with a display box to receive a display panel, wherein a souvenir is detachably attached to the panel.

KR utility patent No. 20-0473753 (Jul. 18, 2014) discloses a decorative article with a plant bed having decoration front and rear portions thereof.

SUMMARY

Thus, the present disclosure provides a decorative article with decorative and storage functions wherein an arrangement of the receiving member is selected by a user.

The present disclosure provides a decorative article with a pattern or shape defined in a base plate and a receiving member being secured thereto at various locations wherein the receiving member may be detachably attached to the base plate.

Further, the present disclosure provides a decorative article to achieve user satisfaction via a selection of an arrangement of the receiving member by the user.

Other objects and advantages of the present disclosure will be more apparent from a following description.

In one aspect, there is provided a decorative article comprising: a base plate having at least one hanging elongate slot defined therein; and a receiving member including a single first plate, at least two second plates, and a hanger, wherein the first plate is parallel to the base plate, and each of the at least two second plates is non-parallel to the base plate and is coupled to the first plate, to define an inner space and a top opening in the receiving member, wherein the hanger protrudes from the first plate, wherein the hanger is fitted into the hanging elongate slot to secure the receiving member to the base plate.

In one implementation, the hanging elongate slot extends horizontally, or has an inverse V shape with a highest middle point or an V shape with a lowest middle point.

In one implementation, the base plate has at least one decorative elongate slot defined therein, wherein the decorative elongate slot is adjacent to the hanging elongate slot to form a geometrical pattern or shape together with the hanging elongate slot.

In one implementation, the first plate falls within the geometrical pattern or shape.

In one implementation, the hanger extends from the first plate along a top edge of the first plate.

In one implementation, the hanger includes: a proximal portion protruding from and perpendicular to the first plate; and a distal portion extending downwardly from the proximal portion in a tilted manner toward the first plate.

In one implementation, the hanger includes: a proximal portion protruding from and perpendicular to the first plate; and a distal portion extending downwardly from the proximal portion in a parallel manner to the first plate.

In one implementation, the hanger is singular wherein the single hanger has substantially the same length as that of a single hanging elongate slot; or wherein the hanger is plural wherein a total length of the plurality of the hanger is substantially the same as that of a single hanging elongate slot.

In one aspect, there is provided a receiving member including: a single first plate, at least two second plates, and a hanger, wherein the first plate is parallel to the base plate, and each of the at least two second plates is non-parallel to the base plate and is coupled to the first plate, to define an inner space and a top opening in the receiving member, wherein the hanger protrudes from the first plate, wherein the hanger includes: a proximal portion protruding from and perpendicular to the first plate; and a distal portion extending downwardly from the proximal portion in a tilted manner toward the first plate; or wherein the hanger includes: a proximal portion protruding from and perpendicular to the first plate; and a distal portion extending downwardly from the proximal portion in a parallel manner to the first plate.

The present disclosure provides the decorative article with decorative and storage functions wherein an arrangement of the receiving member is selected by a user; a pattern or shape is defined in a base plate and a receiving member is secured thereto at various locations and the receiving member is detachably attached to the base plate; and an user satisfaction is achieved via a selection of an arrangement of the receiving member by the user.

DETAILED DESCRIPTIONS

Hereinafter, embodiments of the present disclosure will be described in details.

Figure 1:
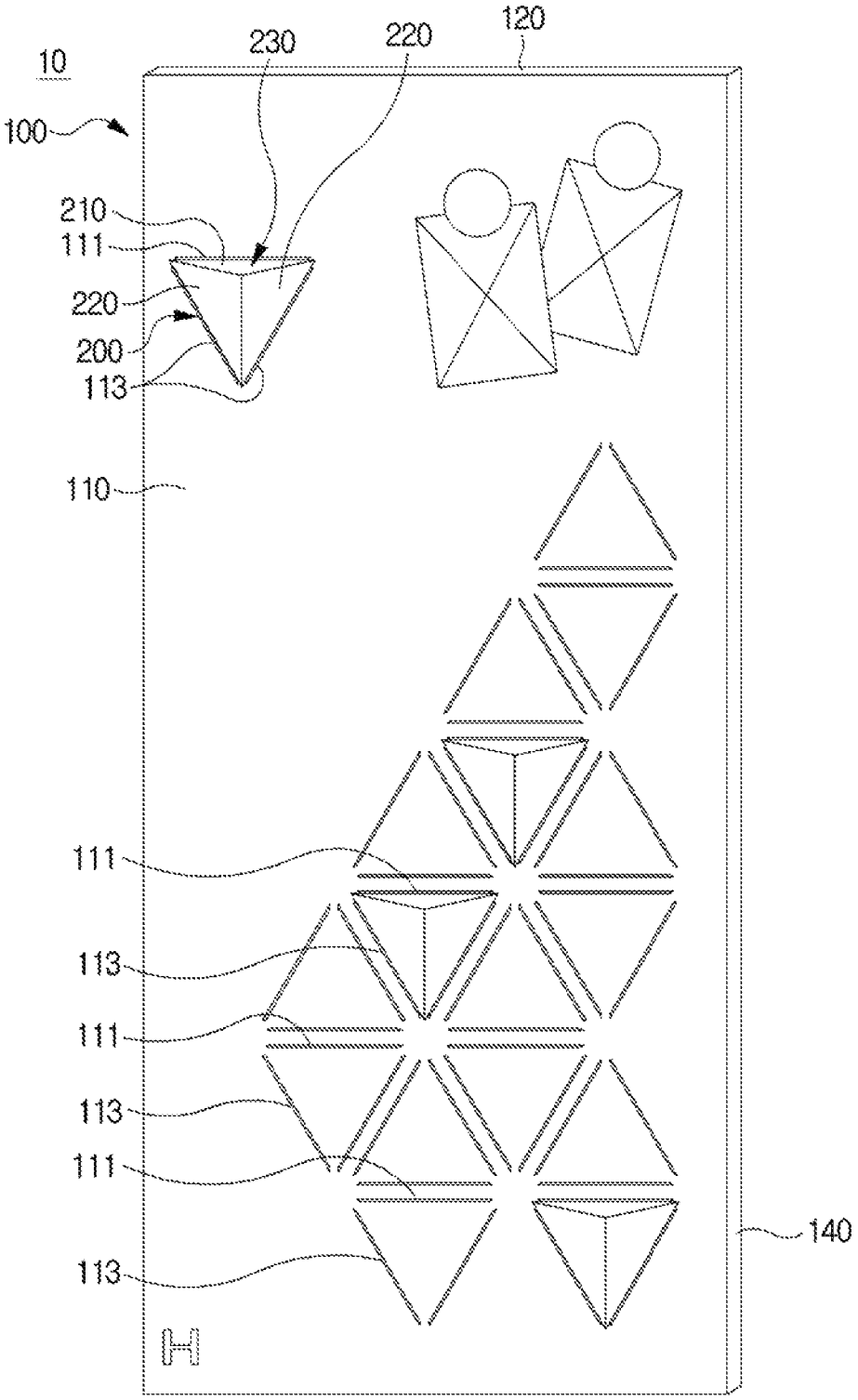
FIG. 1 shows a partial exploded perspective view of a decorative article in accordance with one embodiment of the present disclosure.

As shown in FIG. 1, the decorative article 10 of the present disclosure may include a base plate 100 and a receiving member 200.

The base plate 100 may include a front plate 110, a top plate 120 extending perpendicularly from a top of the front plate 110, a bottom plate extending perpendicularly from a bottom of the front plate 110, and both side plates 140 extending perpendicularly from both sides of the front plate 110 respectively. In an alternative, it may dispense with the top plate 120, the bottom plate, and the both side plates 140. The front plate 110, the top plate 120, the bottom plate, and the both side plates 140 may be monolithic. Thus, the top plate 120, the bottom plate, and the both side plates 140 may be bent from the front plate 110. In an alternative, the top plate 120, the bottom plate, and the both side plates 140 may be coupled to the front plate 110 via a welding.

The front plate 110 may have at least one hanging elongate slot 111 defined therein. The hanging elongate slot 111 may receive therein a hanger 240 of the receiving member 200 as will be later described. The hanging elongate slot 111 may be embodied as a horizontal hanging elongate slot as shown in FIG. 1. The hanging elongate slot 111 may be plural. Thus, the decorative article of the present disclosure may hold a plurality of receiving members 200 thereon.

The front plate 110 may have, in addition to the hanging elongate slot 111, at least one decorative elongate slot 113 defined therein. The decorative elongate slot 113 may not receive the hanger 240 of the receiving member 200. That is, the decorative elongate slot 113 may act as a decorative structure. In one example, the hanging elongate slot 111 and the decorative elongate slot 113 may have the same shape. The decorative elongate slot 113 may be adjacent to the hanging elongate slot 111 to form a geometrical shape together with the adjacent hanging elongate slot 111. In FIG. 1, a single hanging elongate slot 111 may be combined with two decorative elongate slots 113 to form a triangular shape. However, the present disclosure is not limited thereto. The combination of adjacent hanging elongate slot 111 and decorative elongate slot(s) 113 may form various geometrical shapes. In an alternative, the combination of adjacent hanging elongate slot 111 and decorative elongate slot(s) 113 may form various pattern and/or designs or characters including animal or plant shapes. The hanging elongate slot 111 and decorative elongate slot 113 may be adjacent in a non-contacting manner. Further, the two decorative elongate slots 113 may be adjacent in a non-contacting manner.

In the geometrical shape formed of the hanging elongate slot 111 and decorative elongate slots 113, the hanging elongate slot 111 and decorative elongate slot 113 may be distinguished from each other based on whether the receiving member 200 is fitted into. Generally, a top of the geometrical shape may be defined as the hanging elongate slot 111 into which the receiving member 200 is fitted into.

A width and/or length of each of the hanging elongate slot 111 and decorative elongate slot 113, and/or a spacing between the hanging elongate slot 11 and decorative elongate slot 113, and/or a spacing between adjacent decorative elongate slots 113 may vary depending on a decoration and a rigidity of the base plate 100. For example, a width of each of the hanging elongate slot 111 and decorative elongate slot 113 may be in a range of about 2 to 20 mm. A length of each of the hanging elongate slot 111 and decorative elongate slot 113 may be in a range of about 50 to 500 mm. each of a spacing between the hanging elongate slot 11 and decorative elongate slot 113 and a spacing between two decorative elongate slots 113 may be in a range of about 5 to 30 mm.

In the base plate 100, a plurality of the hanging elongate slots 111 may be arranged to exhibit a decoration. The decoration of the geometrical shape may be more visible and/or more various when the combination between the decorative elongate slot 113 and the hanging elongate slot 111 is achieved.

The base plate 100 may have a non-slot region where the hanging elongate slot 111 and decorative elongate slot 113 are not defined. In this non-slot region, a memo sheet may be attached thereto. Further, when the base plate 100 is made of a magnetic metal such as an iron, the memo sheet may be disposed on the base plate 100 in the non-slot region and a magnet may be disposed on the memo sheet to fix the sheet to the base plate 100. An arrangement of the non-slot regions and slot-regions may be achieved to allow the base plate 100 to have a decoration function. The base plate 100 may be made of a plastic.

When the base plate 100 is made of a metal, the hanging elongate slot 111 and decorative elongate slot 113 may be formed using a punching. When the base plate 100 is made of a plastic, the hanging elongate slot 111 and decorative elongate slot 113 may be formed using an injection molding.

Figure 2:
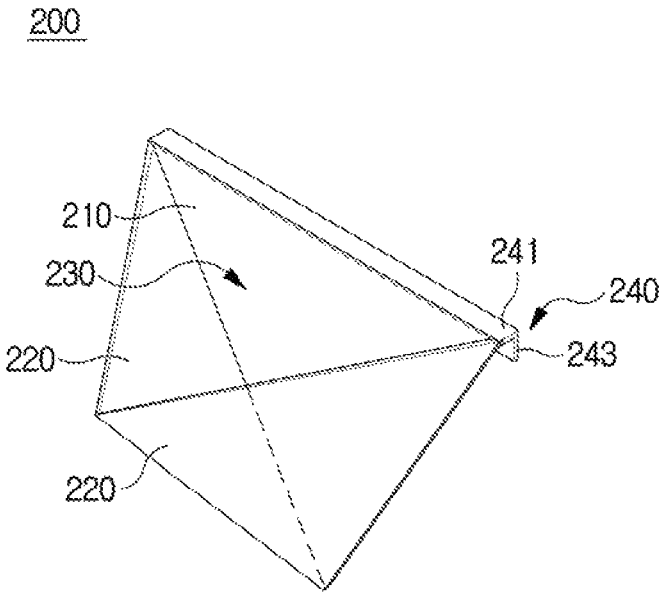
FIG. 2 shows a perspective view of a receiving member applied to the decorative article in FIG. 1.

Next, the receiving member 200 may include, as shown in FIG. 1 and FIG. 2, a single first plate 210 parallel with the base plate 100 and at least two second plates 220 non-parallel with the base plate 100. The first plate 210 and second plates 220 may be monolithic. However, in an alternative, the first plate 210 and second plates 220 may be separable with each other. The receiving member 200 may be formed using an injection molding or a welding. The first plate 210 and second plates 220 may define a top opening in the receiving member 200. Thus, the receiving member 200 may have an inner space defined therein to receive various articles including the pencil, ball-pen, comb, bar type article, etc. In another example, a soil may be filled into the inner space in the receiving member 200 to allow the member 200 to act as a plant bed.

The first plate 210 may be bordered by the hanging elongate slot 111 and decorative elongate slots 113. In this connection, as shown in FIG. 1, the first plate 210 may have a triangle shape. Three sides of the first plate 210 may correspond to the hanging elongate slot 111 and two decorative elongate slots 113 respectively. The hanger 240 may be formed along the top side of the first plate 210. The length of the hanger 240 may correspond to a length of the hanging elongate slot 111. The first plate 210 may have a geometrical shape substantially identical with a geometrical shape defined by the hanging elongate slot 111 and decorative elongate slot 113.

A shape or pattern formed by the hanging elongate slot 111 and decorative elongate slots 113 may encompass the first plate 210. In one example, a shape or pattern formed by the hanging elongate slot 111 and decorative elongate slots 113 may substantially correspond to a shape or pattern of the first plate 210.

When the shape or pattern formed by the hanging elongate slot 111 and decorative elongate slots 113 encompasses the first plate 210, or a shape or pattern formed by the hanging elongate slot 111 and decorative elongate slots 113 substantially corresponds to a shape or pattern of the first plate 210, the decorative article 10 of the present disclosure may exhibit both of decoration and storage functions. That is, using the decorative article 10 of the present disclosure, the shape or pattern formed by the hanging elongate slot 111 and decorative elongate slot 113 may exhibit a decoration function. The receiving member 200 attached to the base plate 100 may exhibit the storage function. In the decorative article 10, the receiving member 200 may not screen the decoration function realized by the base plate 100 but may allow a more sophisticated geometrical shape or pattern by the combination between the base plate 100 and the receiving member 200.

In FIG. 1 and FIG. 2, the receiving member 200 having the single first plate 210 and tow second plates 220 may be shown by way of example. However, the present disclosure is not limited thereto. The first plate 210 and second plate 220 may have a triangular shape. The second plate 220 may be coupled to the first plate 210. The first plate 210 and second plate 220 may define an inner space or receiving space 230 in the receiving member 200 having a top opening. That is, the second plate 220*s* may not be parallel to the first plate 210 to define the receiving space 230.

The receiving member 200 may be made of a metal such as an iron or may be made of a plastic. The receiving member 200 may be formed by combining the first plate 210 and second plate 220 using a welding. In an alternative, the receiving member 200 may be formed by an injection molding.

The receiving member 200 may include the hanger 240. The hanger 240 may protrude from the first plate 210. The hanger 240 may protrude from the first plate 210 at a top edge of the plate. The hanger 240 may be fitted into the hanging elongate slot 111 formed in the base plate 100 to secure the receiving member 200 to the base plate 100.

The hanger 240 may include, as shown in FIG. 2, a proximal portion 241 and a distal portion 243. The proximal portion 241 may protrude perpendicularly from and to the first plate 210. To be specific, the proximal portion 241 may protrude perpendicularly from and to the first plate 210 at a top edge of the first plate 210. That is, the proximal portion 241 may be perpendicular to the first plate 210. The distal portion 243 may be tilted from the proximal portion 241 downwardly toward the first plate 210.

In an alternative, the hanger 240 may include a proximal portion 241 and distal portion 243'. The proximal portion 241 may protrude perpendicularly from and to the first plate 210 at a top edge of the first plate 210. That is, the proximal portion 241 may be perpendicular to the first plate 210. The distal portion 243' may extend downwardly from the proximal portion 241 to be parallel with the first plate 210.

The hanger 240 and first plate 210 may be monolithic. Further, the proximal portion 241 and distal portion 243 may be monolithic. Further, the proximal portion 241 and distal portion 243' may be monolithic. This may be achieved using an injection molding.

The distal portion 243 or distal portion 243' may be inserted into the hanging elongate slot 111 defined in the front plate 110 and then may support the back face of the front plate 110 to secure the receiving member 200 to the base plate 100. Further, the proximal portion 241 may be inserted into the hanging elongate slot 111 to contact the base plate 100, namely, the front plate 110. That is, the receiving member 200 may be secured to the base plate 100 by a cooperation between the first plate 210, and the proximal portion 241 and distal portion 243 or distal portion 243' of the hanger 240.

In this way, the decorative elongate slot 113 may not be screened by the first plate 210 but the hanging elongate slot 111 may be fitted with the hanger 240. Thus, the hanger 240 may substantially screen the hanging elongate slot 111. The hanging elongate slot 111 may be visible only at both sides and a top thereof.

The hanger 240 may be embodied as a single hanger to extend across the entire length of the first plate 210. In this connection, the hanger 240 may have a length substantially equal to that of the hanging elongate slot 111. In an alternative, the hanger 240 may be plural. The plurality of the hangers 240 may be inserted into the single elongate slot 111. A total length of the plurality of the hangers 240 may be substantially equal to that of the single hanging elongate slot 111.

Figure 3:
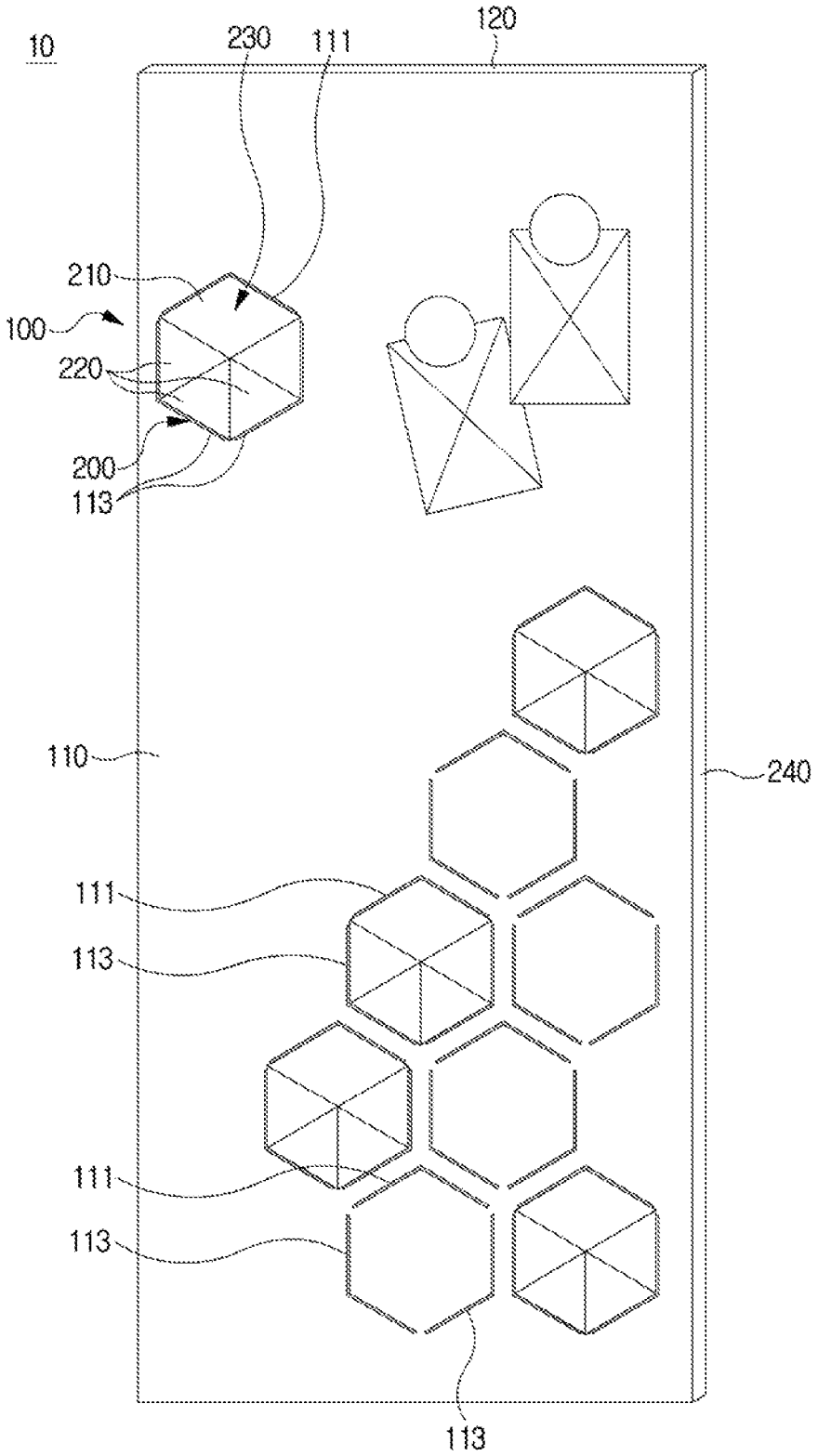
FIG. 3 shows a partial exploded perspective view of a decorative article in accordance with another embodiment of the present disclosure.
Figure 4:
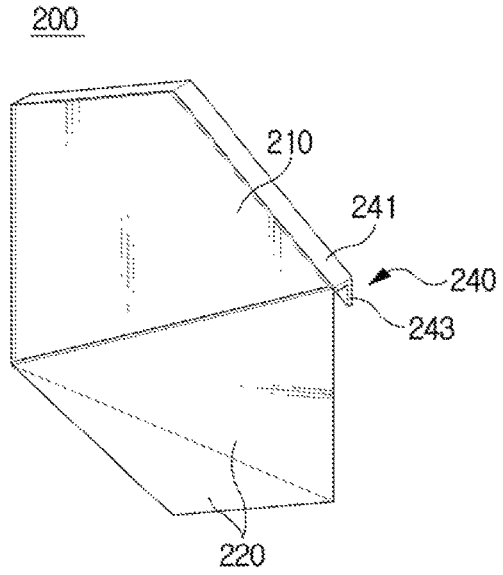
FIG. 4 shows a perspective view of a receiving member applied to the decorative article in FIG. 3.

FIG. 3 shows a partial exploded perspective view of a decorative article in accordance with another embodiment of the present disclosure. FIG. 4 shows a perspective view of a receiving member applied to the decorative article in FIG. 3.

As shown in FIG. 3, the decorative article 10 may be different from the decorative article 10 as shown in FIG. 1 in terms of a shape of the hanging elongate slot 111. As shown in FIG. 3, the decorative article 10 may have a non-linear hanging elongate slot 111 with an inverse V shape having a highest middle point. Each of the decorative elongate slot 113 may have substantially the same shape as that of the non-linear hanging elongate slot 111 except for an orientation thereof. Thus, the single hanging elongate slot 111 and two decorative elongate slots 113 may form a hexagonal shape.

As shown in FIG. 3, the decorative article 10 may have a receiving member 200 having a first plate 210 as shown in FIG. 4. The first plate 210 may have a hexagonal shape defined by the hanging elongate slot 111 and decorative elongate slots 113.

The decorative article 10 may have a non-linear hanging elongate slot 111 with an inverse V shape having a highest middle point. Each of the decorative elongate slot 113 may have substantially the same shape as that of the non-linear hanging elongate slot 111 except for an orientation thereof. Thus, the single hanging elongate slot 111 and two decorative elongate slots 113 may form a hexagonal shape. As shown in FIG. 3 and FIG. 4, the receiving member 200 may include four second plates 220, wherein each of the second plates 220 has a triangular shape. In this embodiment, the first plate 210 may contact and be parallel with the front plate 110, and each of the second plates 220 may contact and be not parallel with the front plate 110.

Although not shown in the figures, the hanging elongate slot 111 may have an V shape with a lowest middle point.

Figure 5:
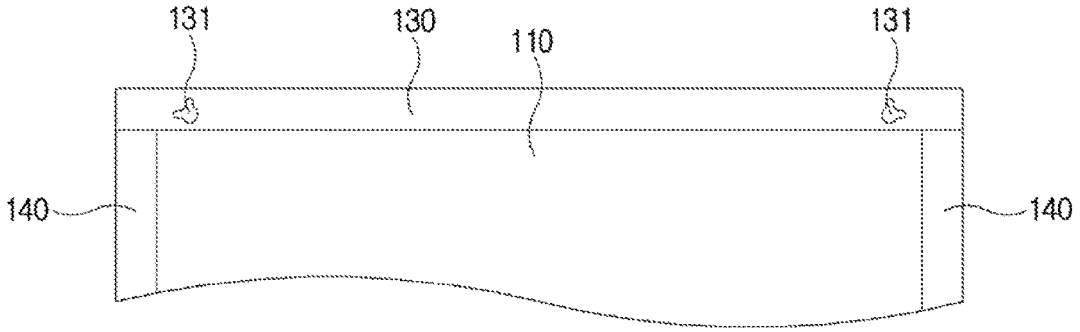
FIG. 5 shows one example wherein a decorative article of the present disclosure has hanger holes defined therein to allow the plate to be hanged on a wall.

As shown in FIG. 5, the decorative article 10 of the present disclosure may have hanger holes 131 defined therein. The hanger hole 131 may allow hangers such as a pin or nail, etc. to be inserted therein to secure the base plate 100 to the wall. The hanger hole 131 may be formed in a front portion of the front plate 110 of the base plate 100. To be specific, in order to hang the base plate 100 on the wall stably and/or to allow the receiving member 200 to be hung on the hanging elongate slot 111 and/or achieve an ornamental aspect, the hanger hole 131 may be formed in a hanger hole free end 130. The hanger hole free end 130 may be bent from the top plate 120 of the base plate 100 to be parallel to the front plate 110. The hanger hole free end 130 may be bent inwardly from the top plate 120 of the base plate 100 to be parallel to the front plate 110. Thus, the hanger hole free end 130 may be hidden to be not visible to the user. Thus, the hanger such as a nail may not be visible to the user. For this, the hanger hole free end 130 may face the front plate 110. This may lead to a good aesthetic aspect of the decorative article 10.

REFERENCE NUMERALS

10: decorative article 100: base plate
110: front plate 111: hanging elongate slot

113: decorative elongate slot 120: top bent plate
130: hanger hole free end 131: hanger hole
140: side bent plates 200: receiving member
210: first plate 220: second plate
230: receiving space 240: hanger
241: proximal portion 243: distal portion
243': distal portion

What is claimed is:

1. A decorative article comprising:

a base plate having at least one hanging elongate slot defined therein; and a receiving member including a single first plate, at least two second plates, and a hanger, wherein the first plate is parallel to the base plate, each of the at least two second plates is non-parallel to the base plate and is coupled to the first plate to define an inner space and a top opening in the receiving member, and the hanger protrudes from the first plate along a top edge of the first plate, wherein the hanger is fitted into the hanging elongate slot to secure the receiving member to the base plate, wherein the base plate has at least one decorative elongate slot defined therein, wherein the at least one decorative elongate slot is adjacent to the at least one hanging elongate slot in a non-contacting manner to form a polygonal shape together with the at least one hanging elongate slot, wherein the first plate falls within the polygonal shape defined by the least one hanging elongate slot and the at least one decorative elongate slot, and sides of the first plate are configured to correspond to the least one hanging elongate slot and the at least one decorative elongate slot such that the first plate has a geometrical shape substantially identical with the polygonal shape.

2. The decorative article of claim 1, wherein each of the second plates is also non-perpendicular to the base plate.

3. The decorative article of claim 1, wherein the hanger includes:

a proximal portion protruding from and perpendicular to the first plate; and a distal portion extending downwardly from the proximal portion in a tilted manner toward the first plate; or wherein the hanger includes:

a proximal portion protruding from and perpendicular to the first plate; and a distal portion extending downwardly from the proximal portion in a parallel manner to the first plate.

4. The decorative article of claim 3, wherein the hanger is singular wherein the single hanger has substantially the same length as that of a single hanging elongate slot; or wherein the hanger is plural wherein a total length of the plurality of the hanger is substantially the same as that of a single hanging elongate slot.

5. The decorative article of claim 1, wherein the at least one hanging slot extends horizontally, or has an inverse V shape with a highest middle point or a V shape with a lowest middle point.

6. The decorative article of claim 5, wherein the at least one hanging slot is a single hanging elongate slot that extends horizontally and the least one decorative elongate slot is two decorative elongate slots, wherein the polygonal shape and the geometric shape are substantially identical triangles, wherein each side of the first plate corresponds to one of the slots.

7. The decorative article of claim 6, wherein the at least two second plates is two triangular second plates, wherein the top opening is triangular.

8. The decorative article of claim 5, wherein the at least one hanging slot is a single hanging elongate slot that has an inverse V shape and the least one decorative elongate slot is two decorative elongate slots having V shapes, wherein the polygonal shape and the polygonal shape and the geometric shape are substantially identical hexagons, wherein each V shaped pair of sides of the first plate corresponds to one of the V shaped slots.

9. The decorative article of claim 8, wherein the at least two second plates is four triangular second plates, wherein the top opening is a quadrilateral.

10. The decorative article of claim 1, wherein the at least one receiving member is a plurality of receiving members each having its first plate fall within a plurality of corresponding polygonal shapes each defined by at least one hanging elongate slot and at least one decorative elongate slot and sides of each first plate are configured to correspond to least one hanging elongate slot and at least one decorative elongate slot such that the first plate has a geometrical shape substantially identical with the polygonal shape, wherein the hanging elongate slots and the decorative elongate slots defining the plurality of polygonal shapes are part of a pattern.

11. The decorative article of claim 10, wherein the pattern further comprises at least one polygonal shape formed by at least two adjacent non-contacting decorative elongate slots having no corresponding receiving member.

12. The decorative article of claim 1, wherein the base plate includes front plate, a top plate extending perpendicularly from a top of the front plate, a bottom plate extending perpendicularly from a bottom of the front plate, and side plates extending perpendicularly from both sides of the front plate.

13. The decorative article of claim 1, wherein the base plate has hanger holes defined therein to allow hangers to be inserted such that the decorative article may be secured to a wall.

14. The decorative article of claim 12, wherein a free end has hanger holes defined therein to allow hangers to be inserted such that the decorative article may be secured to a wall, wherein the free end is bent from the top plate of the base plate to be parallel to the front plate.

15. The decorative article of claim 1, wherein the base plate is made of a magnetic metal, wherein an item may be magnetically affixed on the base plate in a non-slot region.

* * * * *